United States Patent [19]

Shoji et al.

[11] 4,272,210

[45] Jun. 9, 1981

[54] INTERCHANGE SYSTEM

[75] Inventors: Sanae Shoji, 5-25 Sumiyoshicho, Numazu-shi, Shizuoka-ken; Shigeo Shoji, 46-5 Niski-Tsutsujigaoka 1 chome, Chofu-ski, Tokyo, both of Japan

[73] Assignees: Sanae Shoji; Kunio Shoji; Michio Shoji, all of Numazu; Shigeo Shaji, Tokyo, all of Japan

[21] Appl. No.: 73,142

[22] Filed: Sep. 6, 1979

[30] Foreign Application Priority Data

Sep. 12, 1978 [JP] Japan ..... 53-111271

[51] Int. Cl.[3] ..... E01C 1/04

[52] U.S. Cl. ..... 404/1

[58] Field of Search ..... 404/1; 14/1; 52/174, 52/175, 176

[56] References Cited

U.S. PATENT DOCUMENTS

| | | | |
|---|---|---|---|
| 1,629,787 | 5/1927 | Hackett | 404/1 X |
| 1,784,728 | 12/1930 | Harriss | 404/1 |
| 1,830,518 | 11/1931 | Mason | 404/1X |
| 1,981,361 | 11/1934 | Jones | 404/1 |
| 2,941,454 | 6/1960 | Cedeno | 404/1 |
| 2,949,067 | 8/1960 | Cedeno | 404/1 |
| 3,847,496 | 11/1974 | Stankiewicz | 404/1 |

OTHER PUBLICATIONS

"A Policy on Geometric Design of Rural Highways", by American Association of State Highway Officials, 1961 Fifth Printing, cited to show Tool of Highway Engineer.

*Primary Examiner*—Nile C. Byers, Jr.
*Attorney, Agent, or Firm*—Oblon, Fisher, Spivak, McClelland & Maier

[57] ABSTRACT

An interchange system serving elevated railways and roadways intersecting each other, which system comprises a rotary possessing of a cylindrical plaza at the center thereof and an annular bus stop compound along the periphery of the plaza, a railcar platform above the rotary, interconnecting passages between the plaza, the bus stop compound and the railcar platform and tunnel-like passages dug across under the rotary to reduce a difference between the levels of the plaza and pedestrian paths formed along the opposite sides of the roadways, thereby to ensure the safety and convenience of pedestrians.

4 Claims, 5 Drawing Figures

INTERCHANGE SYSTEM

BACKGROUND OF THE INVENTION

This invention relates to an interchange system comprising a combination junction of pedestrian paths, roadways and railways. More particularly, the invention relates to an interchange system which can be safely, efficiently, and easily utilized for a combination junction of pedestrian paths, roadways and railways.

The interchange system for roads in general contemplated by the present invention is a combination junction of separate levels which permits elevated railways such as for streetcars, monorail cars and unmanned trolley cars to be passed over two or more intersecting or branching roadways laid on the ground surface. Generally, in the case of an intersection of two roadways, when the two roadways cross each other in one plane, the intersection must be provided with traffic signals designed to regulate the traffic past the intersection and, when the two roadways cross each other at separate levels, the intersection must be provided with by-passes designed to route turning traffic from one roadway to the other. The former intersection obstructs smooth flow of traffic because it is required to stop traffic intermittently for the purpose of traffic control and the latter intersection occupies much space and entails consumption of great volumes of construction materials. Further, the designs of such intersections place little or no emphasis on the safety of pedestrians or on reducing the amount of walking pedestrians must do. For example, an intersection may be provided with an overpass or underpass to increase the safety of pedestrians, but no attention is given to the fact that this will require pedestrian to climb long stairs or ramps. The strain on pedestrians is also often increased by installing stops and other facilities used for the operation of urban transportations facilities such as streetcars and buses at inconvenient locations.

An object of this invention is to provide an interchange system which ensures the safety and convenience of pedestrians and users of urban transportation facilities at a combination junction of pedestrian paths and railways, facilitates the arrival and departure of vehicles at the combination junction and, at the same time, permits traffic streams through the junction to flow continuously and smoothly.

SUMMARY OF THE INVENTION

To attain the object described above according to this invention, there is provided an interchange system serving elevated railways, roadways and pedestrian paths formed along the opposite sides of the roadways, which interchange system comprises

- a rotary constructed on a level above the ground surface and consisting of a cylindrical vacant space, an annular bus stop compound formed along the periphery of the cylindrical vacant space and an annular vehicular road formed along the circumference of the annular bus stop compound,
- a platform formed above the rotary and adapted to ensure the convenience of users of railcars in entering and leaving railcars,
- a circular plaza formed at the bottom of the cylindrical hollow space by removing earth to a depth slightly below the ground surface,

- interconnecting passages for providing communication between the circular plaza, the annular bus stop compound and the platform for railcars, and
- tunnel-like passages dug across under the rotary to reduce a level connection between the circular plaza and pedestrian paths formed along the opposite sides of the roadways.

Since a little difference exists between the level of the pedestrian paths formed along the opposite sides of the roadways, that of the tunnel-like passages and that of the circular plaza, pedestrians moving across these areas enjoy, in addition to personal safety due to perfect isolation from the traffic zones, freedom from the added burden of walking which would be involved if these areas had varying levels. Moreover, since the bus stop compound and the platform for railcars are located above the circular plaza, pedestrians on the plaza are afforded easy access to buses and railcars.

Since one circular direction is fixed for the travel of vehicles within this rotary, all vehicles entering the rotary from varying directions are allowed quite freely to merge themselves into the circular flow of vehicles and separate themselves out of the flow and turn into roadways leading to their respective destinations. Despite the fact that the traffic streams in the converging roadways meet in one common plane, therefore, as a general rule, the continuous flow of vehicles through the rotary need not be interrupted as by means of traffic signals, rendering practicable the materialization of an intersection which permits natural flow of continuous traffic streams.

The inclusion in each incoming roadway of a lane exclusively for the travel of urban buses serves the purpose of providing the urban buses easy access to the bus stop compound within the rotary while paying due respect to the community policy of attaching priority to the urban bus services.

The other objects and characteristics of the present invention will become apparent from the further disclosure of the invention to be given hereinafter with reference to the accompanying drawing.

Figure 1:
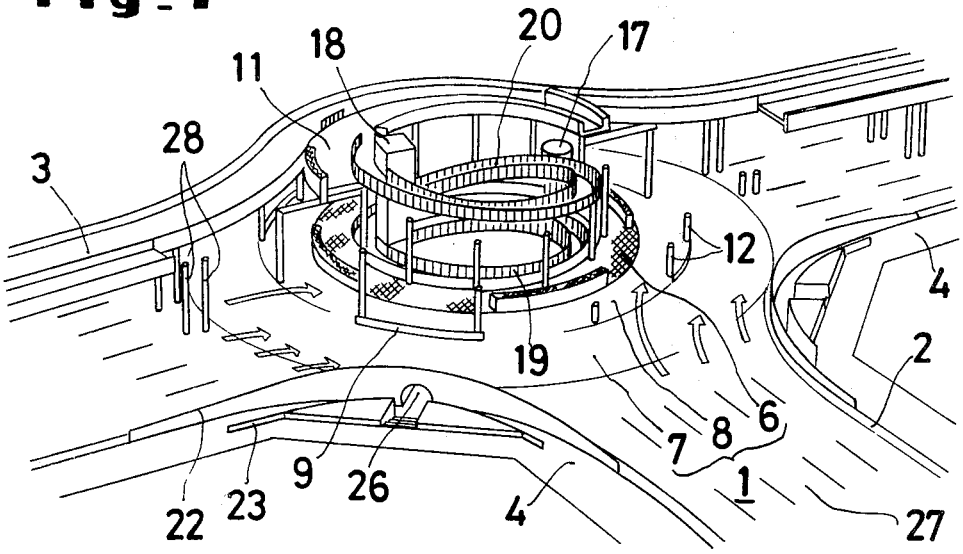
FIG. 1 is a partially cut-away perpective view of one embodiment of the interchange system according to the present invention.
Figure 2:
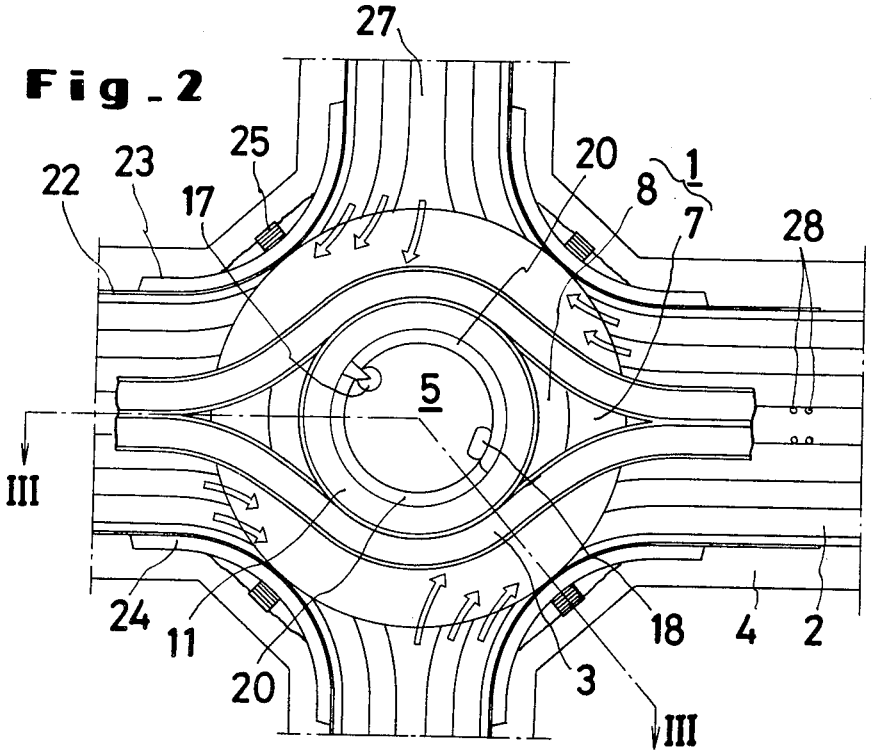
FIG. 2 is a plan view of the interchange system of FIG. 1.
Figure 3:
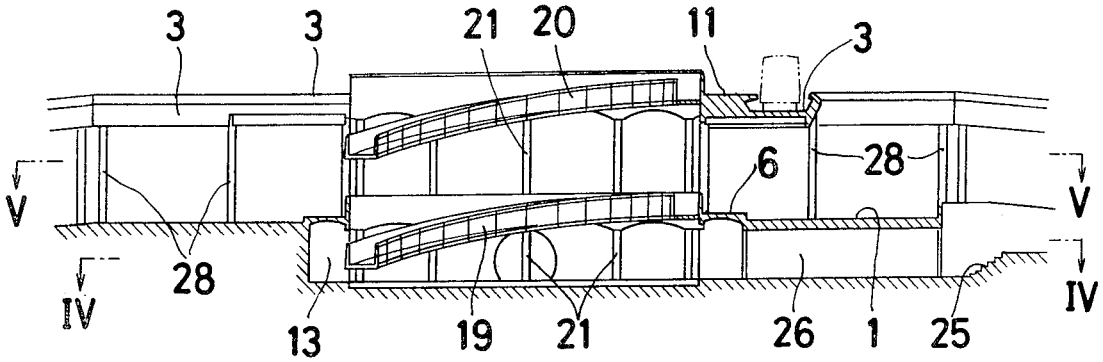
FIG. 3 is a sectioned view taken along the lines of III—III of FIG. 2.

DESCRIPTION OF THE PREFERRED EMBODIMENT:

This invention relates to an interchange system formed of a combination junction of elevated railways and roadways intersecting each other on the ground surface, which interchange system is constructed so as to ensure the safety and convenience of pedestrians and users of transportation facilities at said combination junction.

The drawing attached hereto represents an embodiment of the interchange system wherein the roadways intersect perpendicularly with each other and the railways are laid in a level elevated from the plane of the roadways. Within the area of the combination junction, a rotary 1 is formed by piling earth to a level slightly higher than the ground surface. Roadways converging toward the combination junction from various directions are connected through gradual upward slopes to the junction, and they join the rotary 1 within the area of this junction. The inclination of the upward slopes of the roadways is desired to be such that the slopes offer no hindrance to the travel of vehicles. The rotary 1 comprises a cylindrical hollow space 5 of a large diameter formed at the center thereof, an annular bus stop compound 6 formed along the circumference of the cylindrical hollow space 5 and an annular vehicular road 7 formed at a level one step below the bus stop. The inner lane 8 of the annular vehicular road 7 which borders on the bus stop compound 6 is defined by guard rails 9 installed at fixed intervals on one circular line. This inner lane 8 serves as a zone for the departue and arrival of buses.

Above the cylindrical hollow space 5 of the rotary 1, an annular platform 11 formed for railcars is supported in position by a multiplicity of supporting columns 12. At the bottom of the cylindrical hollow space 5, there is formed a circular plaza 10 dug to a level below the ground surface and possessed of a diameter substantially equalling the diameter of the cylindrical hollow space. To afford pedestrians ample freedom of movement, the circular plaza 10 is required to have a depth of at least 2 meters. Since the rotary 1 is formed by piling earth above the ground surface, the required depth of the plaza can actually be secured by digging earth to depth of a little over 1 meter from the ground surface. The earth thus removed by the digging can be utilized for the formation of the rotary 1.

Figure 4:
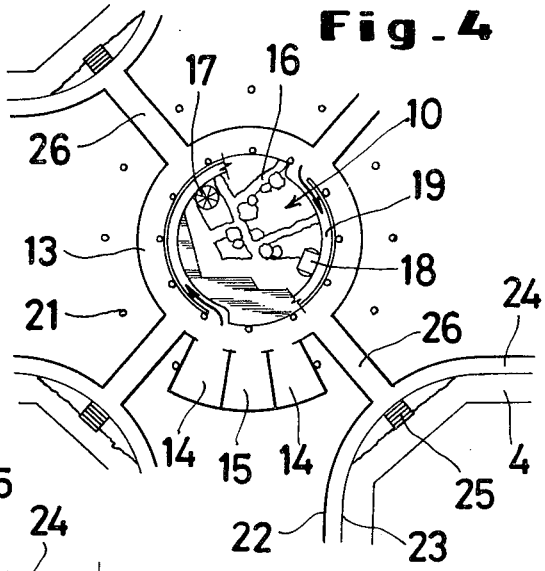
FIG. 4 is a sectioned view taken along the lines IV—IV of FIG. 3.
Figure 5:
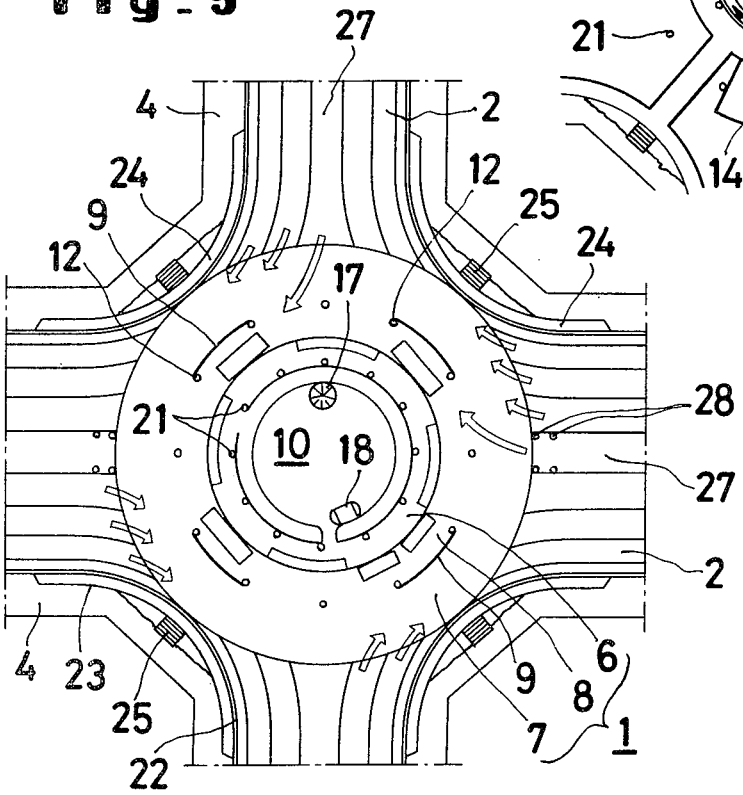
FIG. 5 is a sectioned view taken along the line V—V of FIG. 3.

As shown in FIG. 4, this circular plaza 10 is provided along its circumference with an annular pedestrian path 13. At a proper position on the outer edge of this annular pedestrian path 13 are installed a lavatory 14, a warehouse (or a store) 15, etc. Inside the circular plaza 10, a promenade 16, flower beds and ponds, spiral staircases 17 and elevators 18 are suitably laid out and trees are planted at a proper density.

Along the inner circular wall of the annular pedestrian path 13, there is formed a helically sloped ramp 19 so constructed that about one half of the total ascent on the ramp reaches the level of the annular bus stop 6 compound of the rotary. Further along the circular inner wall of the annular bus stop compound 6, there is formed a helically sloped ramp 20 so constructed that one complete ascent on this ramp reaches the level of the annular platform 11 of the elevated railway 3. These helically sloped ramps are supported in position by a multiplicity of supporting columns 21.

On both sides of each roadway 2, pedestrian paths 4 are formed one each at a level even with the ground surface. The roadways 2 and their adjoining pedestrian paths 4 are divided each by a lateral edge 22. Within the area of the combination junction, walls 23 are installed at fixed intervals in the pedestrian paths along the lateral edges 22. Pedestrian decks 24 which are formed between the lateral edges 22 and the walls 23 are gradually sloped downwardly from the opposite ends to the center thereof. The terminals of these downward slopes of the pedestrian decks 24 are substantially flush with the surface of the circular plaza 10 and communicate with the annular pedestrian path 13 of the circular plaza 10 via tunnel-like passages 26 formed across under the rotary 1. Consequently, pedestrians on the pedestrian path 4 have ready access to the circular plaza 10 through the pedestrian deck 24 and the tunnel-like passage 26. Through the helically sloped ramps 19, 20, they can also reach the annular bus stop compound 6 or the platform 11 for railcars. By 25 is denoted a flight of stairs which affords communication between the pedestrian path 4 and the lower ends of the downward slope of the pedestrian deck 24.

A lane 27 running along the center of each roadway 2 is exclusively intended for buses headed toward the combination junction. In the exclusive bus lanes 27, supporting columns 28 adapted to support in position the railways 3 for railcars are serially planted in such a manner as to avoid interfering with the smooth travel of buses on the lane. In the illustrated preferred embodiment, only one bus lane 27 is included in each roadway 2. The buses departing from their bus stops made a right turn into the roadways leading to their respective destinations in the same way as other ordinary vehicles. As occasion demands, however, there may be included two bus lanes to afford traffic of buses in the opposite directions.

Examples of railcars which the railways may serve include streetcars, trolley buses, monorail cars and unmanned computerized cars. Thus, the railways 3 are constructed so as to suit the particular kind of railcars to be actually operated thereon and the annular platform 11 is constructed so as to facilitate the movement of users from the platform of the railcar interior and vice versa.

In the combination junction constructed as described above, when a pedestrian on the pedestrian path 4 wishes to ride on a bus or railcar, for example, he has only to proceed from the roadway 4 to the lower end of the downward slope of the pedestrian deck 24 through the pedestrian deck or the flight of stairs 25, then walk through the tunnel-like passage 26 to the annular pedestrian path 13 of the circular plaza 10, and ascend the helically sloped ramp 19 to reach the bus stop 6.

Buses running on the center lane 27 of the roadway 2 enter the area of the junction and advance toward the lane 2 intended exclusively for the departure and arrival of buses. When other ordinary vehicles traveling on the righthand lanes enter the area of the junction, they are required to cover one quarter of the complete circle of the rotary 1 for a right turn, one half of the complete circle of the rotary to continue straight or three quarters of the complete circle of the rotary for a left turn before they enter the roadways they are expected to follow past the junction. The buses, therefore, can travel quite readily from the center lanes 27 to the innermost lane in the area of the junction to arrive at the designated bus stops. The buses departing from their fixed bus stops are required to run along the outer lanes of the rotary in the same way as other ordinary vehicles and make a left turn into the roadways leading to their destinations. Along the annular bus stop compound 6, an area may be reserved exclusively for the departure and arrival of taxi cabs at a point selected so that the travel of buses from and to the annular bus stop compound will remain obstructed.

When a pedestrian on the annular bus stop compound 6 further ascends the helically sloped ramp 20 by nearly one complete circle thereof, he reaches the platform 11 for railcars. As he stands on this platform which is annular in shape, he can look down at the circular plaza through the cylindrical hollow space which forms the center of the rotary.

To reach the bus stop or the platform for railcars from the annular pedestrian path 13, the pedestrian is only required to ascend the helically sloped ramps 19, 20. Otherwise, access may be obtained by the pedestrian by utilizing either the spiral staircase 17 or the elevator 18.

When the passenger of a railcar or a bus wishes to change cars or to go to the pedestrian path 4, he has to reverse the aformentioned procedure, i.e. to descend the helically sloped ramps 19, 20 and proceed from the annular pedestrian path 13 via the tunnel-like passage 26 to the pedestrian path 4. In this case, when there are provided two each of the helically sloped ramps 19, 20 instead of just one each thereof as described above, possible congestion of traffic of pedestrians on the ramps may be avoided by designating one of each pair of ramps for ascending pedestrians and the other for descending pedestrians.

For the sake of bicyclists, a lane for exclusive use by bicyclists may be built along the roadway side edge of the pedestrian path 4. Similarly to the pedestrian mentioned above, a bicyclist on the bicycle lane can obtain access to a desired path by traveling from the pedestrian deck 24 through the nearest tunnel-like passage 26, the annular pedestrian path 13 and another tunnel-like passage 26 opening into the path he has selected.

As is clear from the description given above, the interchange system of the present invention enjoys notable simplicity of structure such that a pedestrian wishing to go to a given bus stop or to the platform for railcars can proceed safely and quickly to the bus stop or platform. Further since most of the interconnecting passages followed in this case by the pedestrian are chiefly slopes of gentle inclinations, they can be traveled easily even by aged persons and persons confined in wheelchairs. A park abounding with a green of trees and built in the middle of the junction overlooking constant traffic streams serves the purpose of mentally relaxing passers-by. Since this circular park is formed on a semi-underground level, it receives natural sunshine. Since the earth dug out in building this park is conveniently utilized for raising the rotary above the ground level, the park proves to be simple to make and inexpensive and contributes much to structural fortification of the junction itself. Moreover, the location of a bus lane along the center line of each of the roadways converging toward the junction facilitates the departure and arrival of buses in the bus stops installed within the rotary and, at the same time, serves the purpose of smoothening the flow of ordinary vehicles through the rotary.

Even when the number of roadways converging toward the junction is three or five, the interchange system of this invention can be formed in the same construction as described above by simply decreasing or increasing the number of tunnel-like passages communicating with the semiunderground circular plaza accordingly.

What is claimed is:

1. An interchange system serving elevated railways, roadways and pedestrian paths formed along the opposite sides of the roadways, which interchange system comprises:

a rotary roadway constructed at a level above the ground surface providing a cylindrical hollow space formed at the center thereof, an annular bus stop compound formed along the periphery of the cylindrical hollow space, and an annular vehicular lane formed along the circumference of the annular bus stop compound and adapted to admit one-way traffic of vehicles, an annular platform including a railway station and located directly above the annular bus stop compound at a level convenient for users of railcars to enter or leave railcars stopped along the platform, a circular plaza located in said hollow space a small depth below the ground surface, interconnecting passages located in said hollow space providing communication among the circular plaza, the annular bus stop compound, and the annular platform for railcars, tunnel-like radial pedestrian passages located under the rotary roadway a substantially level connection between the circular plaza and pedestrian decks formed along the opposite sides of the roadways, and gradual slopes formed across the borderlines of the rotary roadway laid on the ground surface and converging into the rotary roadway so as to smooth the entry into and departure from the rotary roadway of traffic streams, whereby communication between the pedestrian paths running along the opposite sides of the roadways is attained through the medium of the tunnel-like pedestrian passages and the circular plaza, and whereby the hollow space is utilized as a means for providing access amongst the vertically separated circular plaza, rotary roadway and annular platform.

2. The interchange system according to claim 1, wherein the interconnecting passages for the communication of the circular plaza, the annular bus stop compound and the annular platform for railcars are helical slopes, spiral stairways and elevators.

3. The interchange system according to claim 1, wherein a lane used exclusively for the travel of buses is formed along the center line of each roadway.

4. The interchange system according to claim 1, wherein the circular plaza is utilized as a park by proper distribution therein of a promenade, flower beds, ponds and trees.

* * * * *